United States Patent [19]

Lantz

[11] Patent Number: 4,528,931

[45] Date of Patent: Jul. 16, 1985

[54] STEPPED FLOTATION APPARATUS

[76] Inventor: George H. Lantz, 7520 Rovena, Anchorage, Ak. 95502

[21] Appl. No.: 523,094

[22] Filed: Aug. 15, 1983

[51] Int. Cl.[3] ..... B63B 1/38

[52] U.S. Cl. ..... 114/288; 114/291; 114/56; 114/67 A

[58] Field of Search ..... 114/291, 288, 289, 290, 114/56, 57, 63, 355, 67 A, 67 R

[56] References Cited

U.S. PATENT DOCUMENTS

| | | | |
|---|---|---|---|
| 1,316,762 | 9/1919 | Bigelow | 114/291 |
| 2,039,585 | 5/1936 | Eddy | 114/291 |
| 2,296,977 | 9/1942 | Brien | 114/291 |
| 2,423,860 | 7/1947 | Van Patten | 114/291 |
| 3,561,390 | 2/1971 | Wallace | 114/67 A |
| 4,348,195 | 9/1982 | Lantz | 440/100 |

*Primary Examiner*—Trygve M. Blix

*Assistant Examiner*—Edwin L. Swinehart

*Attorney, Agent, or Firm*—Poms, Smith, Lande & Rose

[57] ABSTRACT

A hull or flotation arrangement for an apparatus moving through water is provided with steps forming a plurality of surfaces on which the apparatus rides. The steps are arranged such that the lower edges of a predetermined number of the steps extend deeper into the water than a predetermined number of the lower edges of the remaining steps. The lower points of the steps are arranged so that predetermined numbers of them are deeper than predetermined numbers of others, so that there is a progression extending deeper and deeper into the water. The steps are so constructed that as the apparatus is moved forward, it rises upwardly in the water, causing the steps to rise out of the water progressively as the speed increases, with the hull then riding on only a few steps, thus reducing drag and increasing efficiency.

7 Claims, 10 Drawing Figures

STEPPED FLOTATION APPARATUS

FIELD OF THE INVENTION

This invention relates in general to a flotation means for an apparatus moving over the surface of water, and more particularly to a specially stepped hull or flotation configuration.

BACKGROUND OF THE INVENTION

It is well known that stepped hulls and multiple stepped hulls can be used on water borne apparatus to reduce the area of engagement between the hull and the water, thereby reducing the drag caused by the water and increasing the efficiency of the apparatus. Under present designs, this is accomplished by building the inclined plane of each step so that the angle of attack between the step surface and the water surface forces the hull upwards and reduces the wetted area of the hull. This conventional stepped hull, however, has only one speed at which the efficiency of the hull is at its optimum. The greater the distance between the steps, the higher the optimum speed of the hull, and the closer the steps are together, the slower the optimum speed. These hulls are designed such that the lower points or lower termination edges (or termini) of all the steps are substantially on a straight line if viewed in a longitudinal profile parallel to and adjacent to the keel. With this configuration, all steps are in contact with the water at every speed.

As the steps move through the water, they depress the immediately surrounding water thereby creating waves which move at constant speed through the water. As the speed of the apparatus increases, the waves have less time to rebound between the steps, so that in prior designs, the rear of the boat will drop until the latter steps are depressed enough into the water to engage a sufficient amount of water to support the stern of the boat. This causes the steps to plow a progressively deeper trough in the water which increases drag and gives the boat an undesirable raised bow attitude.

Accordingly, the principal objects of the present invention are to provide a flotation apparatus which minimizes the deficiencies in the present designs by providing means to maintain the apparatus substantially level as it moves through the water, while at the same time allowing predetermined numbers of individual steps to rise above the surface of the water as the speed of the apparatus increases, thereby reducing the drag caused by the water and increasing the efficiency of movement.

Another object of the invention is to provide a range of optimum speeds by progressively reducing the surface area in contact with the water as the speed of the apparatus increases, and to maintain the apparatus in an essentially horizontal orientation, rather than allowing it to assume an undesirably high bow attitude.

Additionally, the present invention provides for more than one optimum speed depending upon the numbers of steps chosen, and their orientation relative to one another.

SUMMARY OF THE INVENTION

In one illustrative aspect of the invention, a hull or flotation means having a forward portion, an aft portion, and a bottom portion is provided with a supportive surface having steps disposed in such a manner that when the apparatus is at rest in calm water, the lower points or lower termination edges of a predetermined number of the steps extend deeper into the water than the lower termination edges of the remaining steps. The surfaces on the steps and their lower termination edges angle outwardly from the approximate centerline of the bottom portion of the flotation means, or hull, and forwardly to the forward portion of the flotation means. Means are provided to move the apparatus through the water with sufficient speed so that as the speed increases, a predetermined number of the lower termination edges of the steps rise above the surface of the water, leaving the lower termination edges of the remaining steps in contact with the water, substantially reducing drag and increasing the efficiency of operation of the apparatus.

In accordance with a broad aspect of the invention, the steps form three lower termination edges, the one nearest the aft end of the flotation means and the one nearest the forward portion of the flotation means both extending the same depth into the water, and with the remaining lower termination edges extending to a depth less than the depth of the other two termination edges. Means are provided for moving the apparatus through the water with sufficient speed so that the shallowest of the three termination edges rises above the surface of the water leaving the remaining two in contact with the water.

In accordance with another aspect of the invention, the steps form five lower termination edges or termini at two different levels, whereby as the speed is increased, the shallowest two of the five termini rise above the water to reduce drag, increasing the efficiency of operation of the invention.

In accordance with another aspect of the invention, the steps form five lower termination edges at three different levels, whereby as the speed is increased, the shallowest one of the five steps rise above the water to reduce drag, then as the speed is increased further, the next two deepest termini rise above the surface of the water even further reducing drag and increasing the efficiency of operation of the invention.

In yet another aspect of the invention, wherein the flotation means is provided with sides, chines, and a substantially "V" shaped bottom, surfaces on the steps in the supportive surface of the flotation means may be continued from the bottom portion outwardly to the chine, then further continued around the chine to the sides of the flotation means and forward to its forward portion. As the surfaces of these steps are extended around the chine, they become substantially perpendicular to and continue up the side of the flotation means, and extend at an acute angle as measured from a horizontal line to the forward side of the surfaces. The surfaces continue forward so that when the flotation means is moving forward, the extensions of the surfaces direct or permit the flow of air downward and around the chine to the surfaces of the steps at and below the waterline, thereby reducing any vacuum which could cause drag.

In a further aspect of the invention, the surfaces of the steps and the lower termini may be angled at forty-five degrees or less to the centerline of the flotation means, as measured from the centerline to the forward portion of the surfaces of these steps and their lower termini.

In yet other aspects of the present invention, the flotation means can be provided with either a substantially "V" shaped bottom, a substantially flat bottom, and the surfaces on the steps can have a rear portion lower than the front portion thereof when the apparatus is viewed at rest in calm water.

Stated more particularly, the surfaces on these steps may form an angle of four degrees or more with a horizontal line which begins at the rear portion of each surface and extends forward.

In accordance with yet another aspect of the invention, the surface of the steps which extend outwardly around the chine of a "V" bottomed flotation means, may be extended at an acute angle of forty-five degrees or less, as the angle is measured from a horizontal line extending forward from the forward side of the surface of the step.

In accordance with another aspect of the invention, the invention includes a plurality of steps disposed in such a manner that when the apparatus is at rest in calm water, the lower termination edges of a predetermined number of these steps extend deeper into the water than the lower termination edges of a second predetermined number of these steps. Progressively, the lower edges of progressive predetermined steps extend less deeply into the water than the lower termini of the prior steps until there are a plurality of such progressions. Then, as the boat hull, or flotation body is moved through the water at progressively increasing speeds, as speed is increased, a progressively greater number of steps rise above the water, reducing drag and increasing the efficiency of operation of the apparatus.

Other objects, features, and advantages of the present invention will become apparent to those skilled in the art, from a consideration of the following description of a preferred embodiment and the accompanying drawings.

DETAILED DESCRIPTION

Figure 1:
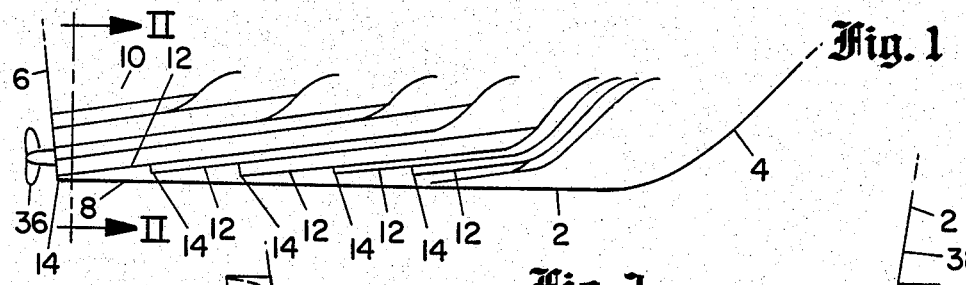
FIG. 1 is a side view illustrating the principles of the present invention as applied to a "V" bottom boat hull.
Figure 2:
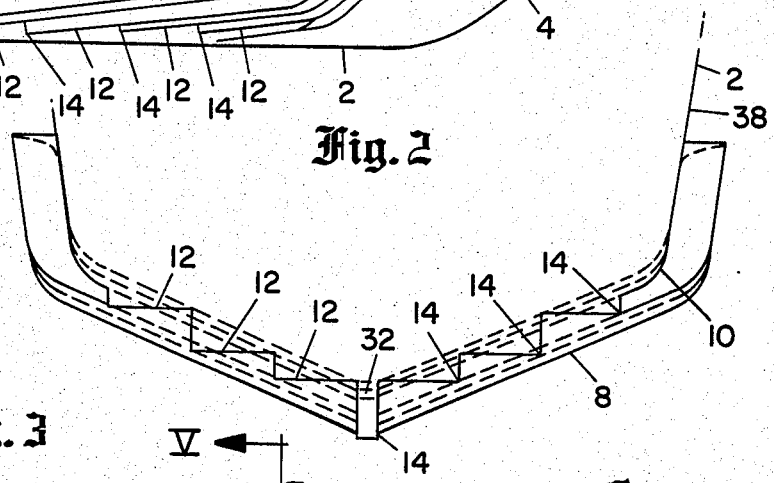
FIG. 2 is a sectional view taken along plane II—II of FIG. 1.
Figure 3:
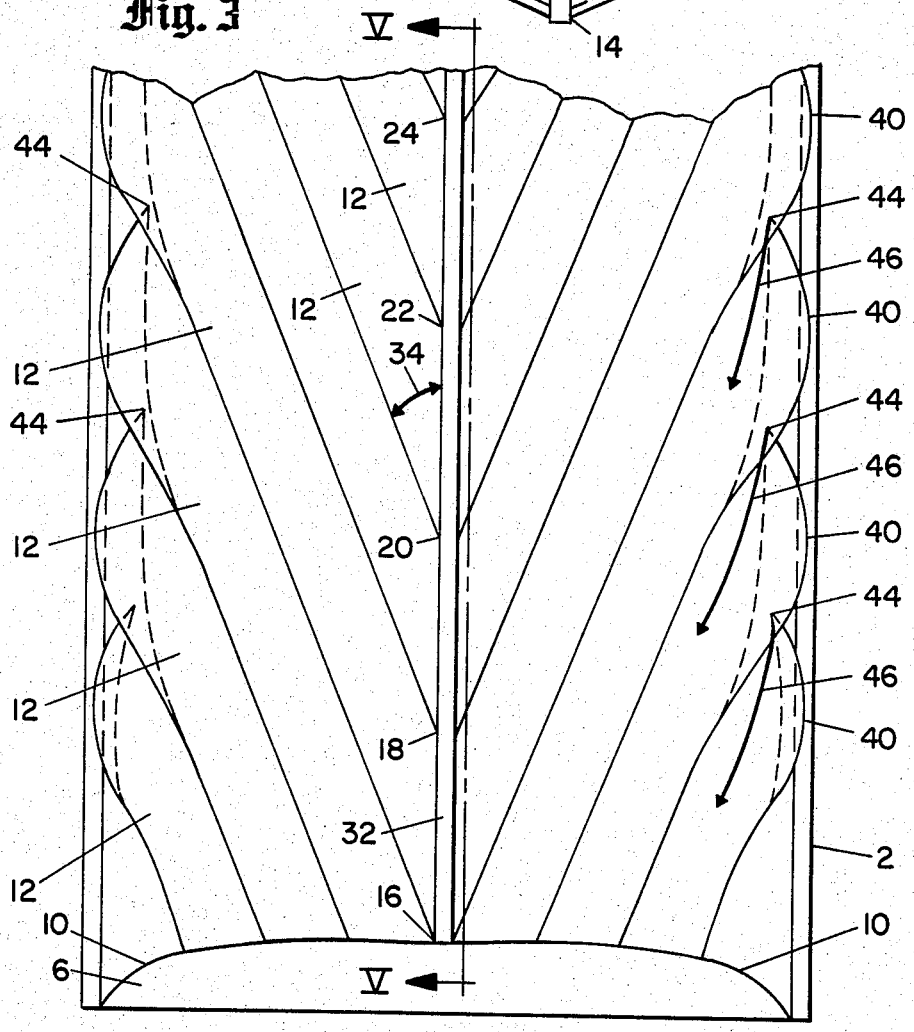
FIG. 3 is a bottom view of the boat hull depicted in FIG. 1.

A preferred embodiment of a stepped flotation means for an apparatus moving over the surface of water, including steps in the water contacting surface of the flotation means for reducing drag as the apparatus moves over the surface of the water, is shown in FIGS. 1 through 10.

The drawings show a preferred embodiment of the invention applied to a "V" bottom boat hull 2, the hull being the flotation means. The hull has a forward portion or bow 4 an aft portion or stern 6, and a bottom portion 8 located below the chine 10, which is the approximate intersection of the bottom and the sides of the boat. In this embodiment, the supportive surface comprises the area of the bottom 8 up to the approximate vicinity of the chines 10.

The bottom 8 is provided with steps 12 which are shown in all the figures. The depths of the steps in the water as well as their number is variable as will be described below.

The steps are disposed on the supportive surface in such a manner so that when the apparatus is at rest in calm water, the lower termination edges 14 of a predetermined number of steps 12 extend deeper into the water than the lower termination edges 14 of the remaining steps. This is shown generally in FIGS. 1 and 2 and in more detail in FIGS. 4 through 10, where the lower termination edges are represented as numbers 16,18, 20, 22, and 24.

Figure 5:
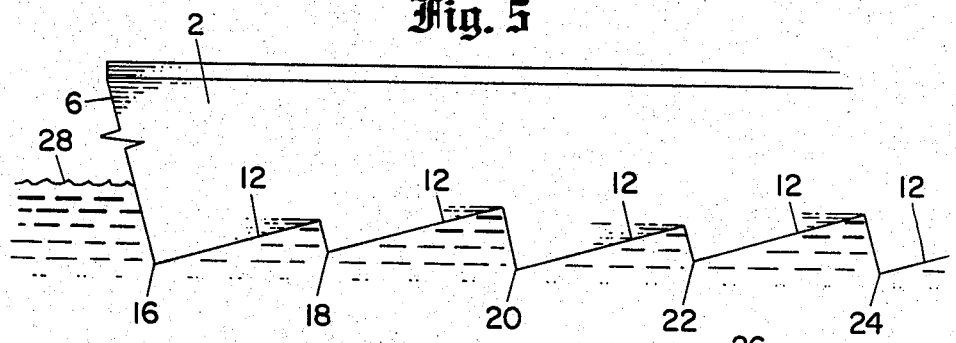
FIG. 5 is a sectional view along plane V—V of FIG. 3 depicting a two depth, five step configuration of the present invention at rest in calm water.
Figure 6:
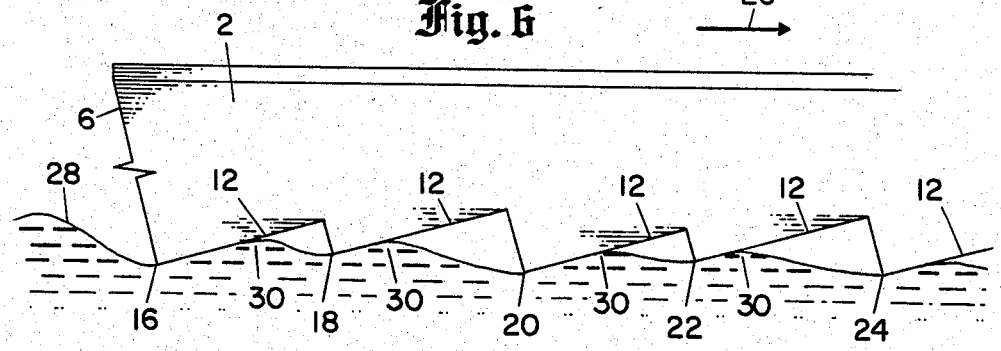
FIG. 6 depicts the embodiment of FIG. 5 in motion in the direction of the arrow at a medium speed.
Figure 7:
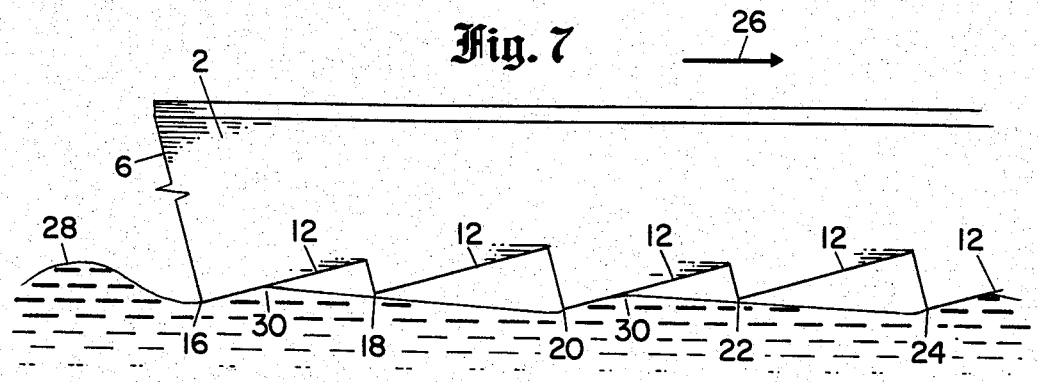
FIG. 7 depicts the embodiment of FIG. 5 in motion in the direction of the arrow at a fast speed.

FIGS. 5, 6, and 7 depict the stepped flotation means in a five step configuration at two depths in the water. Termination edges 16, 20, and 24 extend the deepest into the water and all to the same depth. Termini 18 and 22 are shallower than the remaining termini but both extend the same depth into the water. This can best be seen in FIG. 5 which depicts the flotation means or hull 2 and the configuration of the steps as the hull 2 rests in calm water.

As the hull 2 begins to move forward in the direction of the arrow 26 (FIG. 6), the water surface 28 reacts to the motion of the steps 12 and lower termini 16–24 through the water. As the water passes under each step 12, waves are formed as depicted by water surface 28 in FIG. 6. The waves are caused because as a step 12 passes over the surface of a given area of water, the water rises due to the higher elevation of the surrounding water. The acceleration of the wave created thereby is constant, so that the distance between the lower termination edges or termini 16 through 24 can be arranged to contact the wave at any point desired. As the speed of the hull 2 increases in direction 26, the angles of the steps 12 cause the boat to rise progressively higher in the water.

At one cruising speed for a hull 2 constructed with steps 12 as in FIG. 5 would be when the water surface 28, after passing any given lower terminus of any step 12, has time to rebound to the approximate water level of the surrounding water before it contacts the next step 12. The action of this rebound and the angle of steps 12 to the surface of the water, gives uplift and causes the hull 2 to rise further out of the water. FIG. 6 shows a hull 2 moving at an optimum speed wherein the water surface 28 has rebounded to the approximent water level of the surrounding water before contacting the next rearward step.

As stated before, as the speed of the hull increases, the hull 2 rises further out of the water. This is depicted in FIG. 7. Lower termini 18 and 22 being the shallowest leave the water surface 28 so that only lower termini 16, 20, and 24 remain in contact with the water surface 28. The difference in depth between lower termini 16, 20, and 24 and lower termini 18 and 22 is chosen so that the rebounding wave 30 passes under lower termini 18 and 22 when the hull 2 is moving at its optimum fast speed. The distance between lower termini 16, 20, and 24 is chosen such that when at this optimum speed, the rebound of the wave 30, which is moving at a constant speed, rebounds to the approximent water level of the surrounding water before it contacts the next rearward step. Therefore, at the maximum optimum speed for a hull 2 as depicted in FIG. 7 would be when lower termini 16, 20, and 24 are in contact with water surface 28, lower termini 18 and 22 are above the water surface 28, and the rebounding wave 30 has risen to the approximent level of the surrounding water before contacting the next rearward step 12 still in contact with the water surface 28.

For a two depth, five step hull configuration as depicted in FIGS. 5–7 there would be two optimum speeds, with the slower optimum speed being approximently one half the maximum optimum speed. The slower optimum speed is depicted in FIG. 6 and the maximum optimum speed is depicted in FIG. 7.

One of the significant advantages to the present invention can be seen from studying FIG. 7. Normally it is advantageous to reduce the surface area of any flotation means in contact with the water in order to reduce drag. In stepped hulls and the multiple stepped hulls previously known, this area of engagement between the hull and the water is accomplished by building the inclined plane of each step so that the angle of attack between the stepped surfaces and the water surface forces the hull upwards and reduces the area. However, the conventional stepped hull has only one speed at which the efficiency of the hull is at its optimum. The greater the distance between the steps, the higher the optimum speed, and the closer the steps are together, the slower the optimum speed, with conventional stepped hulls where the lower termini of all the steps are on a straight line, and all at the same depth, when viewed from the side as the hull is at rest in calm water. With these prior configurations, all steps are in contact with the water at any speed. As the speed increases the water has less time to rebound between steps, so the rear of the boat will drop until the latter steps are depressed enough to engage sufficient water to support the stern of the boat. This causes the steps to plow a progressively deeper trough in the water which increases drag and gives the boat an undesirable bow attitude. Finally, when the optimum speed is reached in these conventional designs, the hull is said to "plane" and the hull returns to its generally horizontal attitude.

FIG. 6 shows the effect of the movement of the present invention, in the two depth, five step configuration, through water at its intermediate optimum speed of approximately one half the maximum optimum speed. Drag is significantly reduced even before the apparatus begins to plane because a large portion of the surface of each step 12 does not contact the water surface 28. In a conventional hull at the same speed, the boat would plow with the stern 6 riding below the bow 4. With the present invention, the plowing effect is greatly minimized and drag is significantly reduced providing a much more efficient and comfortable mode of travel.

Figure 8:
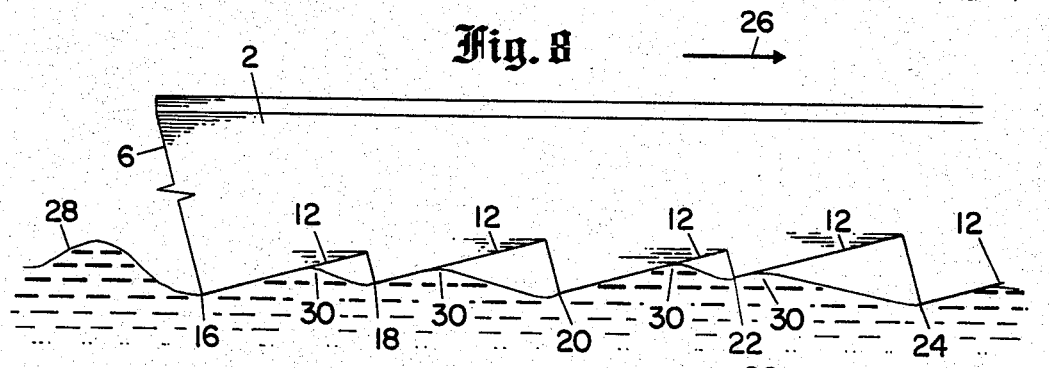
FIG. 8 is a sectional view along Plane V—V of FIG. 3 depicting a three depth, five step configuration of the present invention, in motion in the direction of the arrow at a slow speed.
Figure 9:
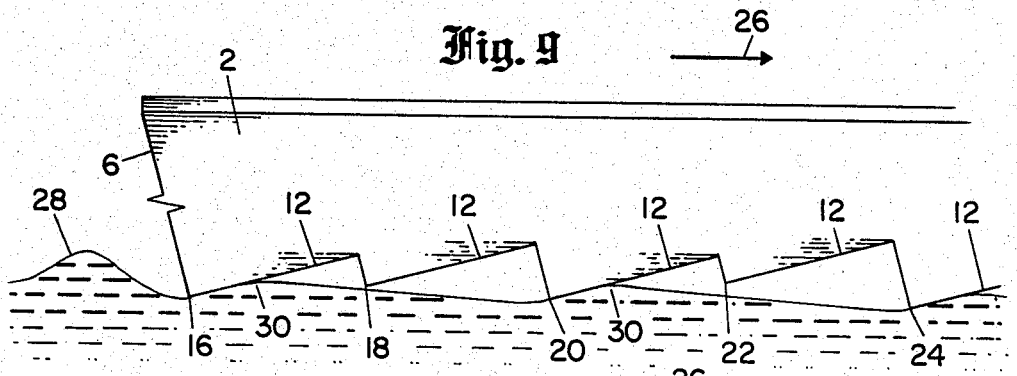
FIG. 9 depicts the embodiment of FIG. 8 in motion at a medium speed.
Figure 10:
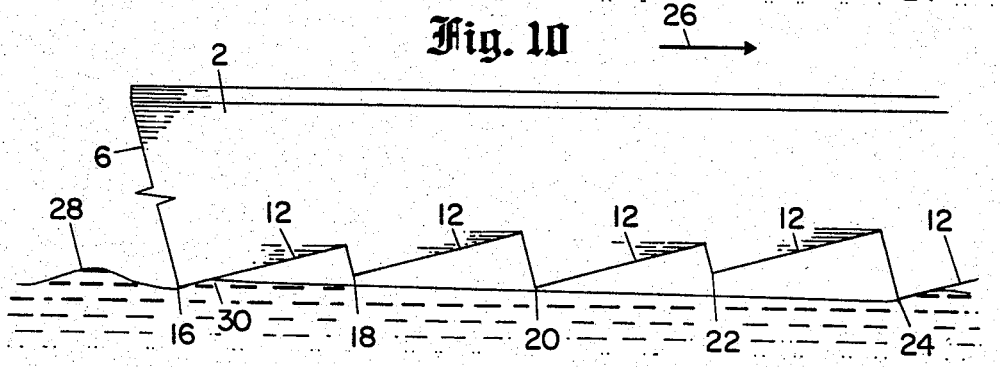
FIG. 10 depicts the embodiment of FIG. 8 in motion at a very high speed.

FIGS. 8, 9, and 10 depict the preferred embodiment of the present invention in a five step, three depth, configuration. When the hull 2 is at rest in calm water, lower termini 16 and 24 extend the deepest into the water, both at the same depth, lower terminus 20 extends the next deepest into the water, and lower termini 18 and 22 are the shallowest, with both of them at the same depth.

FIG. 8 shows the hull 2 moving in direction 26 at its slowest optimum speed. As in FIG. 6, which depicts the two depth, five step configuration, the rebounding water surface 30 has risen to the approximate water level of the surrounding water before contacting the next rearward step. Drag is significantly reduced, and the hull 2 remains essentially horizontal in the water.

As the forward motion of hull 2 increases, it rises further out of the water until lower termini 18 and 22 disengage from the water surface 28. Drag is dramatically reduced as a result, yet the hull remains in an essentially horizontal attitude. As was the case in the two depth configuration, the rebounding wave 30 passes under the lower termini 18 and 22, rises to the approximate height of the surrounding water, and then contacts the next rearward steps 12 depicted in FIG. 9 as ending in lower termini 16 and 20.

FIG. 10 shows the three depth, five step configuration at its maximum optimum speed where the hull 2 has risen out of the water to a height where lower termini 18, 20, and 22 have disengaged from the water surface 28. The rebounding wave, moving at an essentially constant speed no matter what the speed of the hull 2, has passed under lower termini 18, 20, and 22, before rising to the approximate height of the surrounding water and contacting the furthest rearward step 12 near lower terminus 16.

For the three depth, five step configuration, the lowest optimum speed, as depicted in FIG. 8 would be approximately one quarter the maximum optimum speed, the intermediate optimum speed as depicted in FIG. 9 would be appoximately one half of the maximum optimum speed. FIG. 10 depicts the three depth configuration at its maximum speed.

In all of these various configuration, as depicted in FIGS. 6 through 10, drag is further reduced by the fact that the water becomes frothy after passing under one or more steps and the air bubbles in the water surface 28 further reduce the drag.

The number of steps 12 can be anywhere from a minimum of three up to an indefinite number.

The steps 12 would be further apart from the front to the rear of the apparatus for a faster maximum design speed, and closer together for a slower maximum design speed. The lower termini would be staggered vertically in the same manner as in the two and three depth, five step configurations depicted in FIGS. 5 through 10 wherein an appropriate number of lower termini would progressively rise away from the surface of the water 28 as the speed of the apparatus progressively increases.

The flotation means may be constructed so as to have only three steps with lower termini at two different depths, the lower terminus nearest the aft end of the flotation means and the one nearest the forward portion of the flotation means both extending the same depth into the water, and with the remaining lower terminus extending to a depth less than the depth of the other two termini. As the apparatus reaches its maximum optimum speed, the shallowest of the three termini rises above the surface of the water leaving the remaining two in contact with the water.

In the preferred embodiment, the surfaces on the steps 12 and the lower termini 14 angle outwardly from the centerline of the bottom portion 8 and forward to the forward portion or bow of the hull 2. In the preferred embodiment, the centerline of the bottom is the keel 32 which can most clearly be seen in FIGS. 2 and 3. In the preferred embodiment, the angle between the lower termini and the keel is 45 degrees or less as shown at 34 in FIG. 3.

A means for moving the apparatus through the water is shown in FIG. 1 as a propeller 36.

In order to further to reduce drag, means are provided to direct air flow to the surfaces of the steps 12. This is accomplished by continuing the surfaces of the steps 12 outwardly to the chine 10, continuing around the chine onto the sides 38 of the hull 2 and toward the bow 4, said surfaces of the steps 12 as they extend around the chine with the step riser 40 becoming substantially perpendicular to and continuing up the side 38 of the hull 2, and extending at an acute angle as measured from the horizontal to the forward side of said surface of said steps 12. The curvature of this extension of the surface of the steps 12 and the step riser 40 can be best seen in FIG. 4 as an extension of the step riser 40, and also in FIG. 3. The angle of this extension as related to the horizontal is depicted at 42 in FIG. 4. The angle at 42 is an acute angle, and in the preferred embodiment is approximately 45 degrees or less. The extension of the step riser 40 continues around the chine 10 and up the sides 38 curving forward and tapering to a point 44 flush with the sides 38 of the hull 2 above the water surface 28.

As the hull 2 moves forward, the extensions 40 direct a flow of air 46 to the surfaces of the steps 12. This further reduces drag by minimizing or eliminating any vacuum which may be caused between the water surface 28 and the surface of the steps 12.

Figure 4:
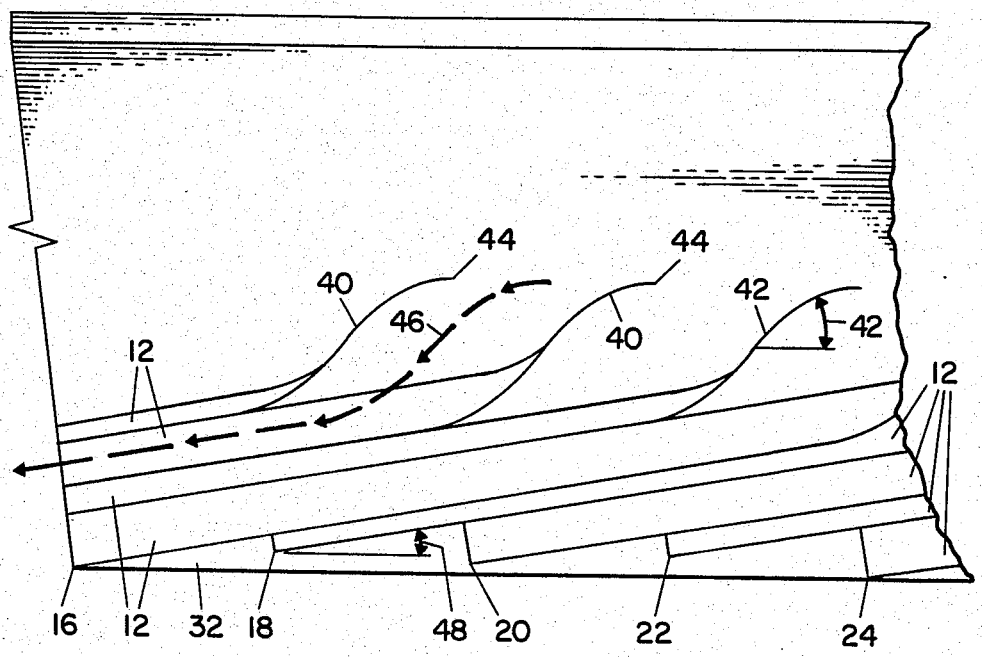
FIG. 4 is a side view of the aft portion of the boat hull depicted in FIGS. 1, 2, and 3.

In the preferred embodiment, the water contacting surfaces of the steps 12 are angled with respect to the horizontal by 4 degrees or more. This angle is depicted in FIG. 4 as step angle 48.

The design of the present invention is adapted for use not only in "V" bottom hulls, but also in hulls or other flotation means having bottom portions 8 which are essentially flat. In these hulls, which have flat bottom portions, means for stability may be provided, such as scags or fins extending into the water.

The stepped configuration of the present invention is also adapted for use in motor sailer hulls, catamaran sail or power hulls, multiple "V" bottom hulls, tricat sail or power hulls, amphibious airplane hulls or airplane float pontoons. The flotation means 2 may be constructed out of any of the materials which are used in hulls as presently known.

It is to be understood that the disclosed apparatus is merely illustrative of the principles of the present invention which could be implemented by other types of structures as noted in the above examples. Accordingly, the scope of the present invention is not limited to the embodiments as shown in the drawings and specifically described herein.

What is claimed is:

1. A flotation means for an apparatus moving over the surface of water, said flotation means having a forward portion, an aft portion, a bottom portion and a centerline, comprising:

a supportive surface on the flotation means which contacts the water;

steps in the supportive surface;

forward and rear portions in said steps;

lower termini in said steps disposed in such a manner so that when the apparatus is at rest in calm water, the lower termini of a predetermined number of the steps extend deeper into the water than the lower termini of the remaining steps;

means for reducing drag between said steps and the water including flat surfaces on the steps extending from the forward to the rear edge portions thereof;

said flat surfaces on said steps and said lower termini angled outwardly from the approximate centerline of the bottom portion of the flotation means, and forwardly to the forward portion of the flotation means;

sides on said flotation means;

chines on said flotation means;

a substantially "V"-shaped bottom on said flotation means;

said surfaces on said steps continuing outwardly to the chine, then continuing around the chine on to the sides and toward the forward portion of the flotation means, said surfaces on said steps as they extend around the chine becoming substantially perpendicular to and continuing up the side of the flotation means, and extending at an acute angle as measured from the horizontal to the forward side of said surfaces on said steps, then curving forward, so that when the flotation means is moving forward, air is directed downward and around the chine to the surfaces on said steps at and below the waterline to reduce any vacuum which would cause drag; and means for moving the apparatus through the water with sufficient speed so that as the speed increases, a predetermined number of the lower termini of said steps rise above the surface of the water, leaving the lower termini of at least two of the remaining steps in contact with the water whereby the apparatus remains relatively horizontal during motion.

2. The flotation means of claim 1 wherein:

with regard to said steps forming three lower termini, the terminus nearest the aft of the flotation means and the terminus nearest the forward portion of the flotation means extending the same depth into the water, and the remaining terminus extending down to a depth less than the depth of the first two termini; and means for moving the apparatus through the water with sufficient speed so that as the speed increases the shallowest of the termini rises above the surface of the water leaving the remaining two termini in contact with the water.

3. The flotation means of claim 1 further comprising:

said steps forming five lower termini, the terminus nearest the aft portion of the flotation means, the terminus nearest the forward portion of the flotation means, and the mid-terminus all extending the same depth into the water, and the two remaining termini, one between the aft most terminus and the mid-terminus, and the other between the forward most terminus and the mid-terminus, extending down to a depth equal to one another but less than the depth of the first three termini;

means for moving the apparatus through the water with sufficient speed so that as the speed increases, the two shallowest of the termini rise above the surface of the water leaving the remaining three termini in contact with the water; and means for moving the apparatus through the water with sufficient speed so that as the speed is increased further, the next shallowest one of the termini rises above the water, leaving the remaining two termini in contact with the water.

4. The flotation means of claim 1 wherein the acute angle is 45 degrees or less.

5. The flotation means of claim 1 wherein the surfaces on said steps and said lower termini are angled at 45 degrees or less to the centerline of the flotation means, as measured from the centerline to the forward portion of the surfaces on said steps and said lower termini.

6. The flotation means of claim 1 wherein the surfaces on said steps have a rear portion lower than the front portion thereof when the apparatus is at rest in calm water.

7. The flotation means of claim 6 wherein the surfaces on said steps form an angle of four degrees or more with a horizontal line beginning at the rear portion of the surfaces and extending toward the forward portion.

* * * * *